United States Patent [19]

Schiess et al.

[11] 4,132,368

[45] Jan. 2, 1979

[54] DRIVE FOR A YARN FEEDER FOR A TEXTILE MACHINE

[75] Inventors: Oskar Schiess, Thalheim; Franz Huber, Winterthur, both of Switzerland

[73] Assignee: Sulzer Brothers Limited, Winterthur, Switzerland

[21] Appl. No.: 845,790

[22] Filed: Oct. 26, 1977

[30] Foreign Application Priority Data

Oct. 28, 1976 [CH] Switzerland ..... 013599/76

[51] Int. Cl.[2] ..... B65H 51/20

[52] U.S. Cl. ..... 242/47.01; 66/132 R; 139/452

[58] Field of Search ..... 242/47.01, 47.02, 47.03, 242/47.04, 47.05, 47.06, 47.07, 47.08, 47.09, 47.1, 47.11, 47.12, 47, 13, 45, 36, 37, 39; 139/452; 66/132 R

[56] References Cited

U.S. PATENT DOCUMENTS

| | | | |
|---|---|---|---|
| 3,225,446 | 12/1965 | Sarfati et al. | 242/47.01 X |
| 3,670,976 | 6/1972 | Vischiani | 242/47.12 |
| 3,759,300 | 9/1973 | Pfarrwaller | 242/47.01 X |
| 3,761,031 | 9/1973 | Pfarrwaller | 242/47.01 |
| 3,791,599 | 2/1974 | Jacobsson | 242/47.12 |
| 3,798,929 | 3/1974 | Balgalvis | 242/47.01 X |
| 3,820,731 | 6/1974 | Rosen | 242/47.12 |
| 3,924,818 | 12/1975 | Pfeifle | 242/47.12 X |

*Primary Examiner*—Stanley N. Gilreath

*Attorney, Agent, or Firm*—Kenyon & Kenyon, Reilly, Carr & Chapin

[57] ABSTRACT

The drive motor for the yarn storage device is controlled by a circuit arrangement which converts a direct current into a variable-frequency three-phase alternating current. The circuit arrangement includes an integrator to produce a trapezoidal control voltage as well as an oscillator, digital counting circuit, three inverter stages and three amplifiers which emit sinusoidal phase currents to the windings of the drive motor.

An electromagnetic brake is also used to brake the drive motor.

7 Claims, 7 Drawing Figures

$t_p$
$t_1$
$t_2$
$t_3$
p
i
f
$S_u$
$S_v$
$S_w$ $t_{Au}$
$16_u$
$17_u$
$S_u$
$S_u$
$U_\sim$
$U_\sim$
$V_\sim$
$W_\sim$
$A_u$
1
$t_{Au}$
$\Delta_u$
$K_u$
U
V
W
$U_e$
$R_u$
$R_v$
$R_w$
$18_u$ $\Delta t$
$S_{ua,b}$
$t_A$
$A_u$
$S'_{ua,b}$

DRIVE FOR A YARN FEEDER FOR A TEXTILE MACHINE

This invention relates to a drive for a yarn feeder for a textile machine, and particularly for weaving machines and knitting machines.

As is known, there are a large number of textile machines of widely differing kinds, which require an intermittent fast feeding of a yarn moving at a very variable speed or a predetermined length of yarn from a stationary state. In order to unwind a yarn, for example from a supply bobbin at as uniform an average speed as possible, the usual practice is to use interim stores in which a predetermined supply of yarn is taken up continuously on a drum and unwound over end for example for picking into a shed, without the occurrence of excessive inertia and friction forces. The yarn can be taken up intermittently in this way either on to a rotating drum by way of a stationary yarn guide or, conversely, on to a stationary drum by way of a rotating yarn guide. As a rule, the torques required to accelerate and decelerate the moving masses are much less in the stationary drum system.

For instance, Swiss Patent Specification No. 439,161 discloses an interim store for weft yarn, and a stationary weft yarn supply bobbin disposed fixedly outside a weaving shed. In use the yarn is drawn off the bobbin through a central bore of a rotating hollow shaft and passes through a yarn guide disposed eccentrically of the shaft to be taken up as a single-layer winding on a stationary drum which has a slight conical taper. The newly arriving yarn is guided first on to a drum portion of increased conicity with, successively applied turns pushing the existing turns of yarn forwardly on the drum. The yarn can be unwound intermittently from the drum over end from the front end of the resulting yarn winding. In so moving the yarn overcomes a reduced amount of residual frictional resistance. In this known yarn store, the hollow shaft and the yarn guide are rotated intermittently to provide a continuous make-up of the stored supply of yarn as required. The rotation is produced by a permanently "on" electric motor, a driving belt and an electromagnetic clutch controlled by a photocell device which scans the front end of the winding advancing on the drum.

A disadvantage of this system, however, is that the current for energizing the clutch must be supplied by way of rubbing contacts whose presence increases the moment of inertia of the parts which have to be accelerated or decelerated at every "on" or "off". Another disadvantage is that the driving motor must remain permanently "on", this leads to heavy current consumption and corresponding heating. Another disadvantage is that the motor can be designed for only one particular mains frequency, e.g. 50 or 60 Hz, and the speed of the motor cannot readily be adjusted steplessly over a wide range for adaptation to the output of the weaving machine. Further, the motor must be dimensioned for a correspondingly high output if starting and decleration times are to be short despite the relatively high moment of inertia of the moving parts.

Accordingly, it is an object of the invention to provide a drive for a yarn feeder which minimizes the use of wearing elements such as clutches, friction brakes and rubbing contacts.

It is another object of the invention to provide a yarn feeder drive which is independent of the mains frequency.

It is another object of the invention to be able to adjust the speed of a drive motor for a yarn feeder over a wide range.

It is another object of the invention to maintain a constant speed during operation of a yarn feeder.

It is another object of the invention to minimize the starting and stopping times of a drive motor of a yarn feeder.

It is another object of the invention to avoid harsh treatment of a yarn during processing on a yarn feeder.

It is another object of the invention to bring a yarn feeder to full speed at start-up without turning back at stoppage.

Briefly, the invention provides a drive for a yarn feeder for a textile machine comprised of a yarn storage device having a storage drum for receiving yarn windings, a yarn detector and a drive motor for activating the storage device to cause a yarn to wind onto the drum. The yarn detector is positioned to sense the presence of yarn at a present point of the drum and to emit a signal in response thereto while the motor has a three-phase exciting winding therein. In addition, the drive has a circuit arrangement for converting a direct current into a variable-frequency three-phase alternating current. This circuit arrangement is connected between the yarn detector and the drive motor for supplying the drive motor with alternating current in response to the presence of yarn at the preset point of the drum.

The circuit arrangement includes:

an integrator which is responsive to the yarn detector signal to produce a trapezoidal control voltage having a value corresponding to a required speed of the driving motor and having a growth flank and a decay flank determinative of the acceleration time and deceleration time, respectively, of the driving motor;

an oscillator for receiving the control voltage and emitting a control pulse sequence in response with the sequence having a frequency proportional to the value of the control voltage;

a digital counting circuit which is disposed after the oscillator to receive the control pulse sequence and which has three output terminals corresponding to the three phases of the required three-phase alternating current. Each of these output terminals is adapted to transmit a sequence of identical rectangular pulses, with a 120° phase shift from one another in consecutive order and with a frequency of a value proportional to the control voltage;

three inverter stages connected one each to an output terminal of the counting circuit to receive a sequence of rectangular pulses and having two output terminals to emit alternating control pulses in phase opposition to the respective incoming pulses from the counting dircuit. Each of these control pulses has a rising or growth flank which is delayed by a predetermined time on the decaying or falling flank of an immediately preceding pulse in phase opposition; and three switching amplifiers each having two input terminals for receiving the incoming control pulses to form a phase current, a choke for shaping the phase current into a sinusoidal pattern and an output terminal for emitting the sinusoidal phase current to the corresponding exciting winding of the driving motor.

According to an advantageous development of the invention, in order to obviate unwanted heating of the end stages of the switching amplifiers and of the exciting winding of the driving motor when the motor is stationary, a blocking circuit arrangement can be provided which blocks or cuts off the circuit when the driving motor is stationary or running at a negligible speed — i.e., until the control voltage exceeds an appropriately low limit value — and, thus, inhibits the exciting current for the driving motor.

Also, in order to increase the deceleration and to stop the driving motor, an electromagnetic brake which is controlled by the yarn detector and responds to a "yarn" signal while releasing in response to a "no yarn" signal, can be provided on a shaft of the motor. The brake can be a d.c. energized eddy current brake or a mechanical brake adapted to be operated by an electromagnet.

Also, to enable the driving motor to be reversed, a reversing switch for changing over the two phases can be provided for the connections between two of the output terminals of the counting circuit and the corresponding input terminals of the inverting stages.

A resistance is also provided at the output of each phase of the exciting winding of the driving motor with a means for tapping off a voltage proportional to the phase voltage from the resistance. A comparator is adapted to receive the tapped voltage and a reference voltage for comparison, the output of the comparator being operatively connected to the counting circuit or to the particular inverting stage concerned, to emit a blocking pulse corresponding to the difference between the compared voltages to supress the rectangular pulses for the duration of such blocking pulse whereby the average duration of rectangular pulse is reduced.

These and other objects and advantages of the invention will become more apparent from the following detailed description taken in conjunction with the accompanying drawings in which.

Like elements and signals have the same references, amplified where necessary by subscripts, throughout.

Figure 1:
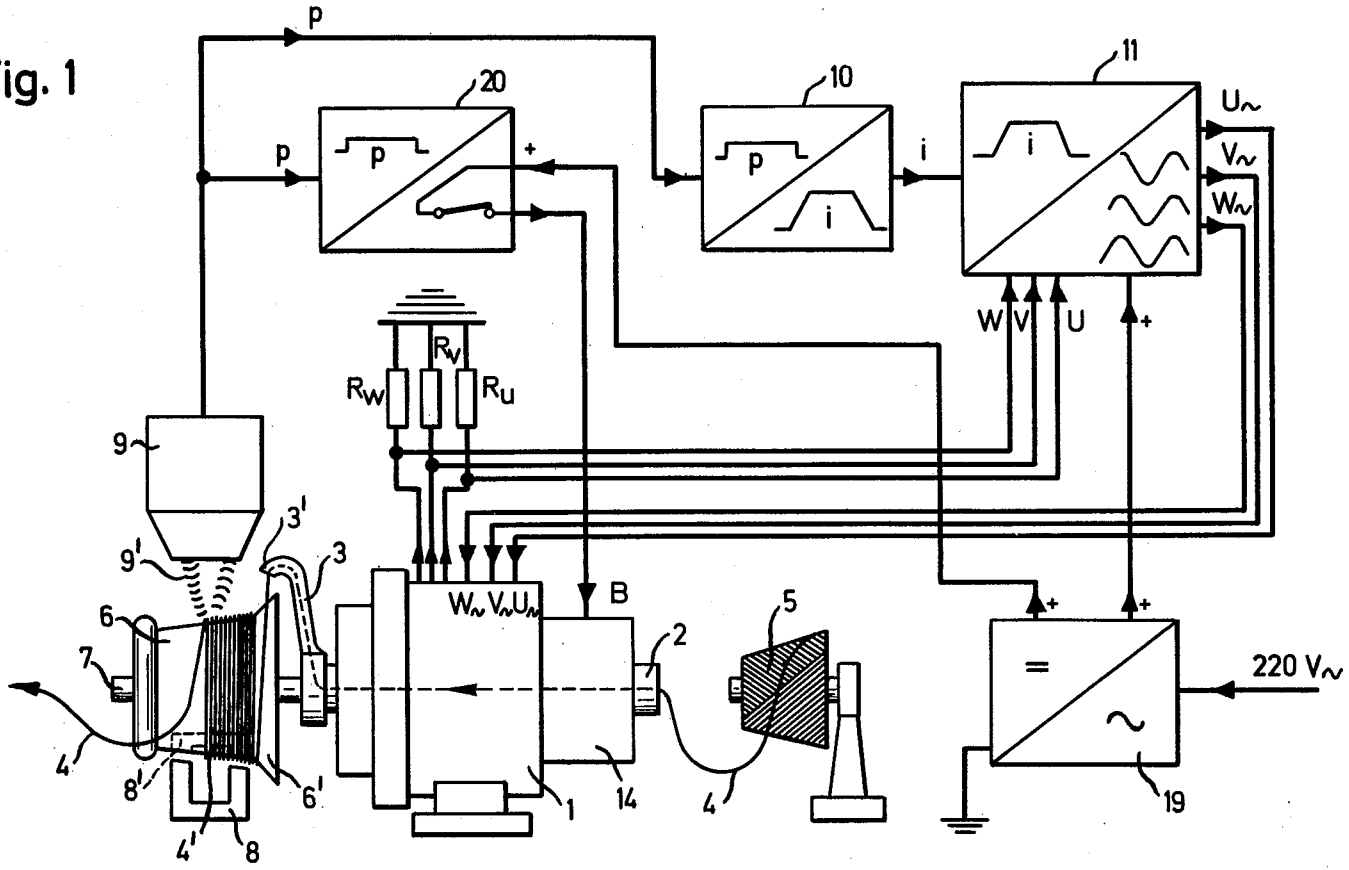
FIG. 1 illustrates a simplified block schematic diagram of a drive according to the invention and of the associated control circuitry used by way of example for a weft yarn interim store for a weaving machine.

Referring to FIG. 1, the drive is used for a yarn feeder, for instance, in an interim weft yarn store of the kind known from Swiss Patent Specification No. 439,161. This drive includes a driving motor 1 which has a hollow shaft 2 in which there is an axial bore. A radially extending short tubular member 3 is disposed at the end of the shaft 2 which is near a storage drum 6 and has a free end forming a yarn guide 3'. A weft yarn 4 extends through the bore in the shaft 2 and through the member 3. The weft yarn 4 is drawn off a stationary bobbin 5 over end — i.e., axially — as required at a speed adjustable to an average value and intermittently — i.e., as long as the shaft 2 and the tubular member 3 rotate — forming a yarn balloon. The yarn runs from the guide 3' onto a short conical part 6' of the storage drum 6, which tapers slightly towards the left-hand end as viewed in FIG. 1. The drum 6 is rotatably mounted on a pin or the like 7 secured to the hollow shaft 2 as an extension thereof; however, a permanent magnet 8 and an armature 8' secured to the drum 6 prevent the drum 6 from corotating with the shaft 2 and spindle or pin 7. Since the yarn guide 3' rotates around the conical part 6', the freshly arriving yarn 4 forms a new turn or winding of yarn at each revolution of the shaft 1. As a result of the yarn tension — which is inherently small — the new turn advances the previously taken-up windings in the form of a single-layer winding 4 — i.e., the newly arriving yarn 4 moves the existing turns of yarn to the left as viewed in FIG. 1 in the manner known e.g. from Swiss Patent Specification No. 439,161.

A yarn detector 9 is mounted at an adjustable distance from the conical drum part 6'. This detector is in the form of a photocell 9 which projects a light beam 9' onto a preset point on the surface of the drum 6. For as long as the front winding of the winding 4' has not reached this point, the beam 9' is reflected, received back by the photocell 9 and produces therein a "no yarn" signal, e.g. in the form of a continuous pulse or signal p which, in a manner to be described hereinafter, controls the frequency F~ of the exciting or energizing current U~, V~, W~ for the motor 1 — i.e., causes the yarn guide 3' to rotate and the interim winding 4' to build up.

The drive also includes a circuit arrangement 10, 11 for converting a direct current into a variable — frequency three phase alternating current. As shown, this arrangement 10, 11 is connected between the detector 9 and the motor 1 for supplying the motor 1 with the alternating current in response to the presence of yarn at the preset point of the drum 6, i.e. in response to the signal p.

Figure 2:
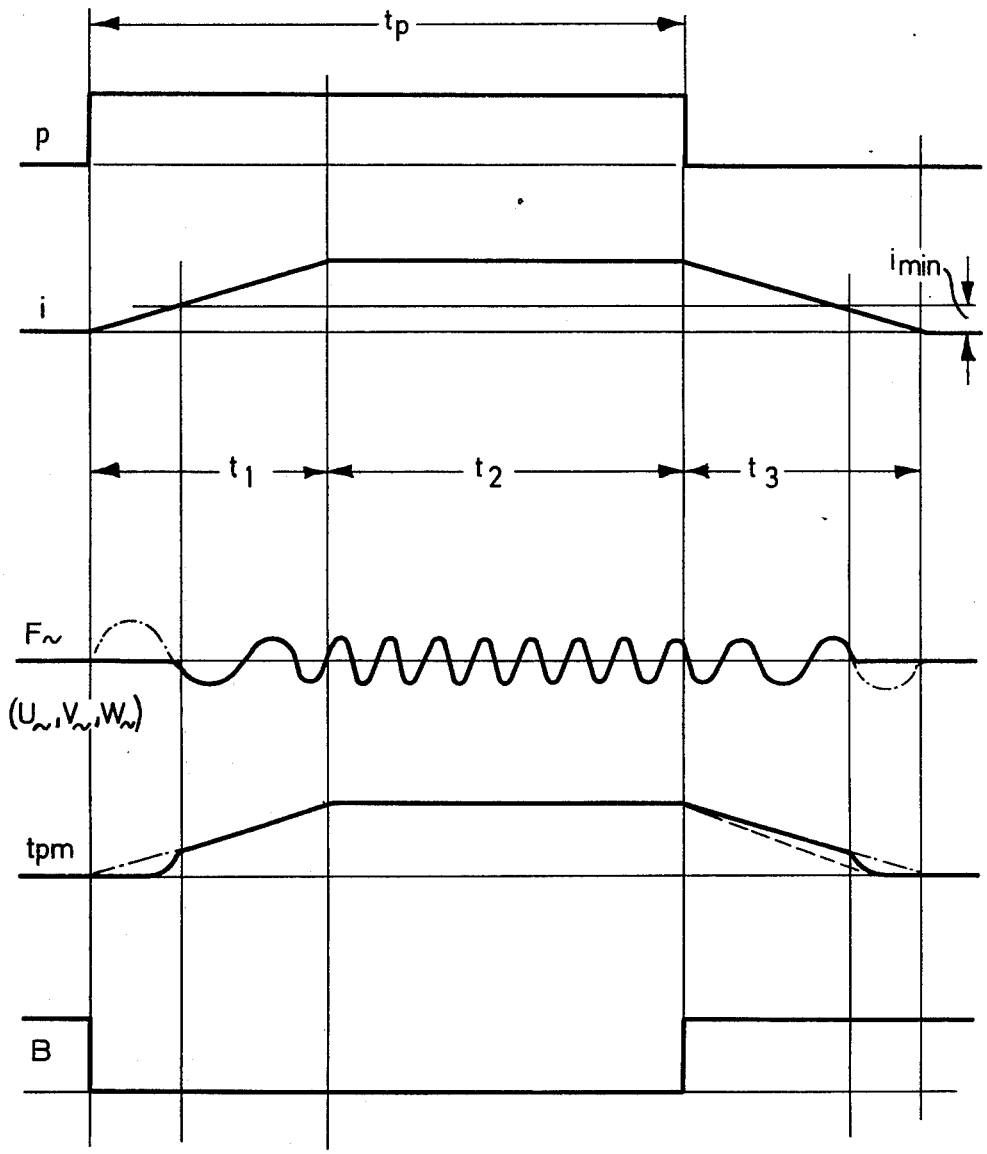
FIG. 2 illustrates a synoptic diagram showing the most important operating parameters or signals plotted against time.

The circuit includes an integrator 10 which receives the signal p and integrates the signal to produce a trapezoidal control voltage i which, as can be seen in FIG. 2, increases continuously from zero to an adjustable steady value, in dependence upon time, during an acceleration step or phase of duration $t_1$. The control voltage i remains at a steady value for a period of time $t_2$ — i.e., while the signal p lasts. This steady-state value of the control voltage i determines the maximum frequency F~ of the three-phase feed current U~, V~, W~ to be produced, so that the steady-state rpm of the motor 1 can be controlled.

When, after a period of time $(t_1 + t_2)$ the front end of the winding r' reaches that region of the drum 6 from which the beam 9' is being reflected, the light refelection must cease. The beam 9' is interrupted and the photocell 9 transmits a "yarn" signal, for instance, by cessation of the continuous pulse or signal p.

Thereafter, the control voltage i is reduced to zero in the integrator 10 similarly, in a continuously decreasing deceleration step or phase of duration $t_3$. Consequently, the frequency F~ of the exciting or energizing current U~, V~, W~ for the motor 1 is reduced correspondingly and the yarn guide 3' ceases to rotate. The weft yarn 4 can be drawn off intermittently from the drum 6 over end — i.e., axially — and picked into the shed of the weaving machine. The beam 9' starts to reflect again from the drum surface, the cell 9 again produces a "no yarn" signal p and, under the control of the remainder 11 of the circuit arrangement, the motor 1 increases the stored yarn supply 4'.

Figure 3:
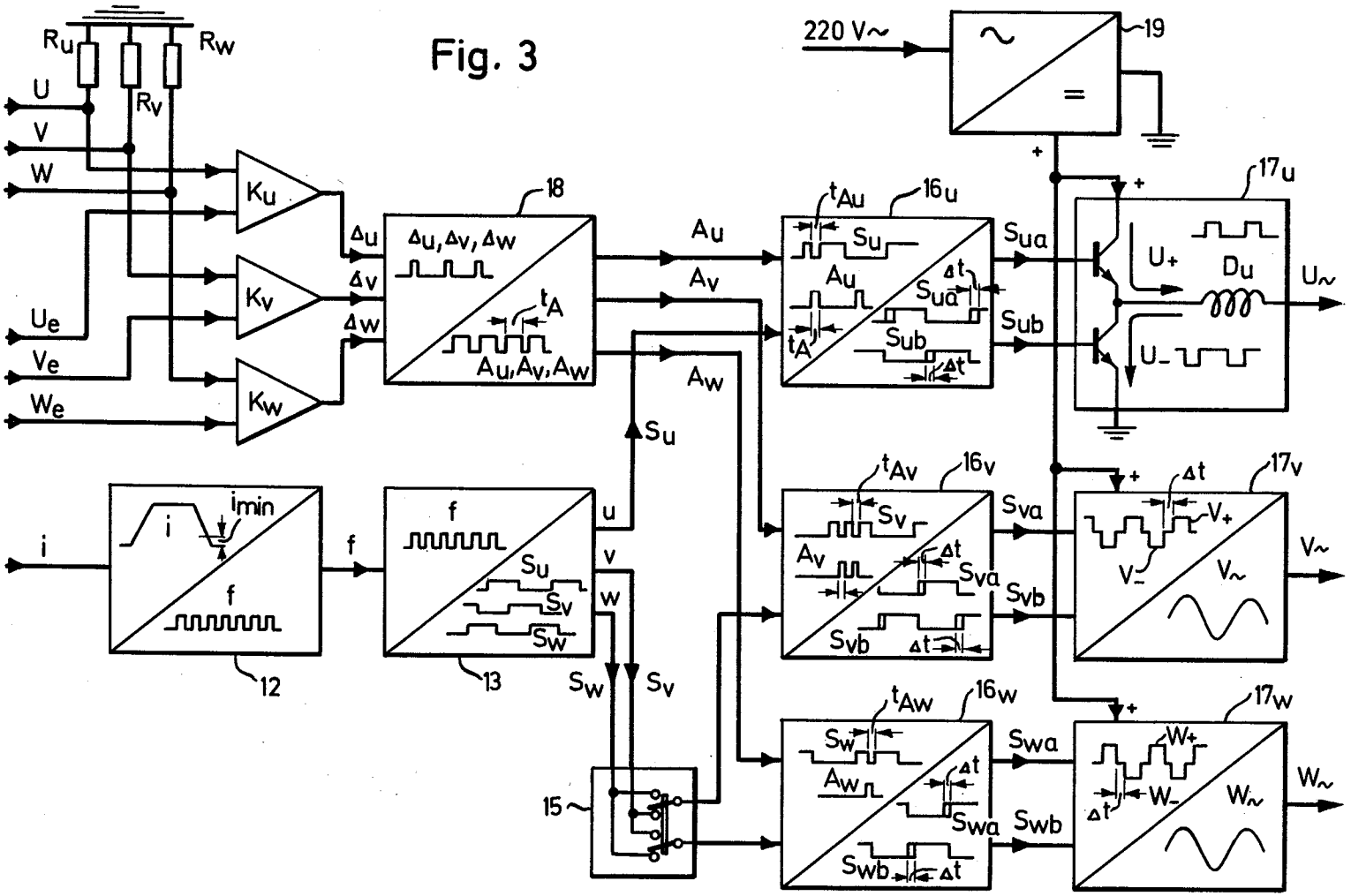
FIG. 3 illustrates a more detailed block schematic diagram serving to show the various subassemblies of the control circuit and of the signals produced therein.

The various subassemblies which make up the internal construction of the remainder 11 of the control circuit arrangement are shown separately in FIG. 3 so that the same can be used to study the events occurring in the conversion, under the control of the control voltage i, of the d.c. supplied by a power pack 19 into a three-phase current having a variable frequency F~.

First, the control voltage i is supplied to a voltage-controlled oscillator 12 which produces a pulse series of a control frequency f, the same being at least one order of magnitude greater than F~ and being proportional to the voltage i. That is, the control frequency f is also trapezoidal and increases continuously in time from zero to a steady-state value, remaining thereat until the continuous pulse p of the yarn detector signal ceases. Whereafter, the frequency f decreases to zero in accordance with the decay step or phase or stage of the control voltage i.

A digital counting circuit 13 is disposed after the oscillator 12 and has three output terminals u, v, w corresponding to the three phases U~, V~, W~ of the required three-phase current. Each output terminal is adapted in known manner to emit a sequence of rectangular pulses $S_u$, $S_v$, $S_w$ of the variable pulse frequency F~ proportional to the control voltage i, all of such pulses being of the same length and all having a pulse ratio of unity but each having a 120° phase shift between consecutive terminals. The diagram shown in FIG. 4 schematically illustrates the principle whereby, in this logical circuit, the pulses arriving from the oscillator 12 at the variable control frequency f are counted and, after a predetermined number of each pulse — i.e., after a number corresponding to the relationship f/F~ — a d.c. voltage is applied seriatim to each of the terminals u,v,w and is interrupted, the required rectangular pulse sequences $S_u$ or $S_v$ and $S_w$ being prepared at the terminals.

Figure 4:
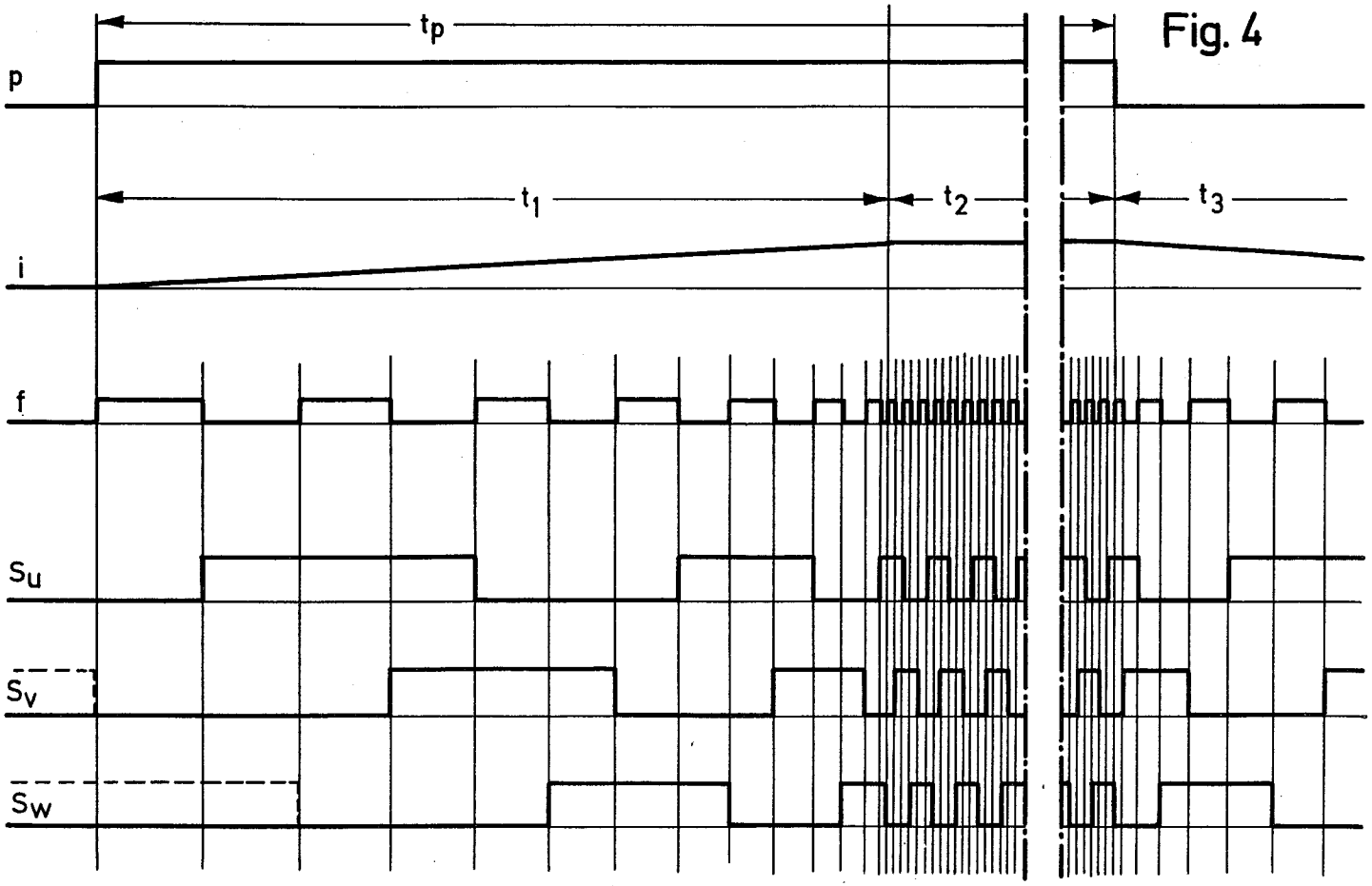
FIG. 4 illustrates a simplified diagram explaining the principle used to form the three variable-frequency phases.

For the sake of simplification, a frequency relationship f/F~ = 3 has been assumed in the diagram shown in FIG. 4. In this cycle of events, one rectangular pulse $S_u$ arises at the terminal u per three pulses of the control frequency f whereafter, and with a delay of one pulse period f, an identical sequence of pulses $S_v$ arises at the terminals v and, after another delay of one pulse period f, a sequence of pulses $S_w$ occurs at the terminal W. In practice, this frequency relationship will probably be higher, e.g. by something like one power of ten, for the sake of a very uniform rise and decay of the frequency F~ of the pulse sequences $S_u$, $S_v$, $S_w$. The timing of the resulting pulse frequency F~ is of course proportional to the trapezoidal pattern of the control voltage i.

Three inverting stages $16_u$, $16_v$ and $16_w$ are connected one each to the output terminals u, v, w of the counting circuit 13 and each has two output terminals a, b from which control pulses $s_{ua}$, $S_{ub}$ and $S_{va}$, $S_{vb}$ and $S_{wa}$, $S_{wb}$ synchronous with the rectangular pulses $S_u$, $S_v$, $S_w$ can be derived. Each rectangular pulse $S_u$, $S_v$, $S_w$ serves to change over, in alternate manner, a d.c. voltage from the particular output terminal a concerned to the terminal b and back again. Thus the control pulses $S_{ub}$, $S_{vb}$, $S_{wb}$ to be derived from the output b are injected at the correct timing into the intervals between the control pulses $S_{ua}$, $S_{va}$, $S_{wa}$ which occur at the output a and which are synchronous with the rectangular pulses $S_u$, $S_v$, $S_b$.

Figure 5:
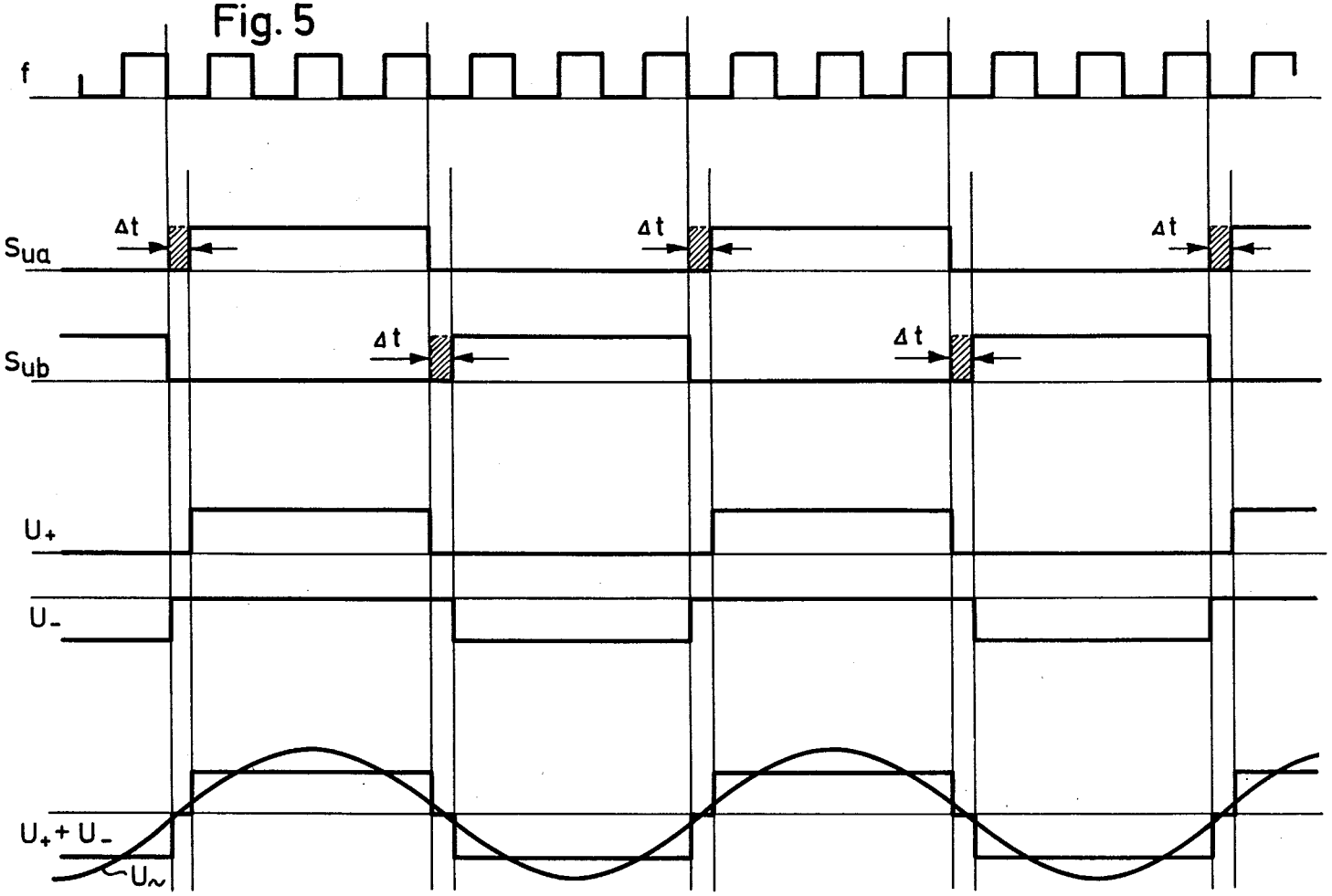
FIG. 5 illustrates another diagram serving to describe the signals used to produce a variable-frequency three-phase a.c. controled by a control frequency.

As can be gathered from FIG. 5, which shows the events occurring in the case of the phase u, the rising flanks of all the control pulses $S_{ua}$ and $S_{ub}$ (the other phases v and w are treated similarly) experience an additional delay of a switching time Δ t on the decaying or falling flank of the immediately previous control pulse terminating at the other output a or b of the particular inverting stage concerned. These delay features are necessary for two reasons. First, so that the changeover events just described and still to be performed in the final stage of the control circuit 11 may be carried out reliably and correctly and, second, so that the shape of the phase currents U~, V~, W~ to be derived from the output of the circuit arrangement 11 and supplied to the exciting or energizing winding of the motor 1 are more nearly sinusoidal.

Finally, the control circuit 11 comprises subassemblies in the form of three switching amplifiers $17_u$, $17_v$, $17_w$ whose end stages are embodied in known manner as push-pull transistor amplifiers similar to the circuit arrangement described in the Bull. SEV 61 (1970) No. 12, 13 June, page 507, FIG. 10. From their input terminals, which are connected two each to the two outputs a, b of the corresponding inverting stage $16_u$ or $16_v$ and $16_w$, the incoming control pulses $S_{ua}$, $S_{ub}$ or $S_{va}$, $S_{vb}$ and $S_{wa}$, $S_{wb}$ are supplied in pairs to the particular final stage concerned.

FIG. 3 shows the switching amplifier $17_u$ in simplified form. As will be apparent, the control pulse $S_{ua}$ is supplied to the base of one push-pull transistor and transmits a positive d.c. pulse U+ to the common output terminal U, whereas the control pulse $S_{ub}$ supplies a negative d.c. pulse U− into the space between two U+ pulses by way of the second transistor. The other two switching amplifiers $17_v$, $17_w$, are of identical construction. The corresponding rectangular frames contain a symbolic representation of the heterodyning of the corresponding positive and negative d.c. pulses V+ and V− and W+ and W− and of the pattern of the corresponding phase current U~, V~, W~ which energizes the energizing winding of the motor 1 directly. This latter pattern is substantially sinusoidal because of the presence of a respective choke winding $D_u$ or $D_v$ and $D_w$.

The diagram given in FIG. 5 shows more clearly the heterodyning or superimpositioning of the positive and negative d.c. pulses U+ and U− controlled by the control pulses $S_{ua}$, $S_{ub}$ and of the substantially sinusoidal shape of the choke-smoothed phase current U~. Similar considerations apply to the other two phases v and w.

This feature limits the strength of the resulting three-phase energizing current U~, V~, W~, and the frequency F~ of such current varies in time substantially proportionally to the value of the control voltage i produced by the integrator 10. Consequently, a rotating field is produced in the air gap of the motor 1, which is a three-phase induction motor, and the magnetic flux of such field remains at a substantially constant value, but the field itself rotates around the motor axis at a velocity $t_{pm}$ proportional to the control voltage i.

If the motor 1 is a synchronous motor, the motor rotor and therefore the hollow shaft 2 and the yarn guide 3' follow the rotation of the field accurately. If the motor 1 is an asynchronous motor, the rotor legs in known manner on the rotating field at a speed reduced by slip.

An advantage of the asynchronous motor is that after a controlled deceleration and stoppage the rotor definitely remains in the first position reached and, unlike what happens in the case, for instance, of a synchronous motor, does not turn backwards through a reduced angle of at most half of a pole pitch. As a result, in the latter case, for instance, a loose loop or baloon of yarn might be produced between the bobbin 5 and the hollow shaft 2 or between the yarn guide 3' and the drum 6. Should such a loose portion of yarn occur, there would be a risk of the yarn breaking at the next restart. Synchronous motors can be prevented from turning backwards by means of an appropriate brake construction and of appropriate adjustment of the brake.

A feature which emerges clearly from a consideration of the diagram shown in FIG. 4 is that in the event of a control circuit 11 comprising merely the subassemblies described, at least one phase of the energizing winding but, as a rule, all three phases thereof remain energized continually — i.e., even when the motor 1 is stationary.

As previously stated, the magnetic field of the motor 1 retains a substantially constant field strength at every speed F~ or $t_{pm}$ — i.e., including zero speed. If this was not the case, the rotor of the motor 1 could not be decelerated to a standstill e.g. by the energizing current U~, V~, W~ and retained in this position. In the absence of any other special steps, therefore, the motor 1 would consume a considerable proportion of the rated full power and the end stages of the switching amplifiers $\mathbf{17}_u$, $\mathbf{17}_v$, $\mathbf{17}_w$ and the energizing or exciting winding of the motor 1 would over heat. In order to obviate this, a blocking circuit of known kind can be provided, preferably in the integrator 10 or in the oscillator 12. When the motor 1 is stationary or running at a negligible speed — i.e., while the control voltage i does not exceed a correspondingly low limit value $i_{min}$ — the blocking circuit renders the oscillator 12 or the circuit 13 inoperative and therefore inhibits the formation of energizing or exciting current for the motor 1.

The diagram in FIG. 2 shows the effect of this feature. A three-phase current U~, V~, W~ of frequency F~ starts to be supplied not immediately when the yarn detector signal p becomes operative but only when the control voltage i exceeds the minimum value $i_{min}$. The supply of the three-phase current ceases when the control voltage i drops below the value $i_{min}$ and not when the voltage i drops to zero. The speed $t_{pm}$ of the rotating field or of the motor behaves similarly. At standstill, the rotor of the motor 1 is not retained in position by a magnetic field produced in the motor air gap. No current flows through the exciting or energizing winding when the motor 1 is stationary, and in this state, there is no unwanted heating of the final stage of the switching amplifiers $\mathbf{17}_u$, $\mathbf{17}_v$, $\mathbf{17}_w$ nor of the motor 1.

In another embodiment, which is important particularly in combination with inhibition of the energizing current U~, V~, W~ as just described, in order to increase the deceleration and to stop the driving motor 1, an electromagnetic brake 14 controlled by the yarn detector 9 and responding to the "yarn" signal p and releasing in response to the "no yarn" signal (p interrupted) is provided on the motor shaft 2. The pattern of the exciting direct current B of the brake 14 is also shown in FIG. 2. The current B is switched on and off by a normally energized switch 20 controlled by the yarn detector signal p. The brake 14 can be preferably a d.c. energized eddy current brake or a mechanical brake operable by an electromagnet. The d.c. eddy brake form is preferred for use in combination with an asynchronous motor, since the effect of the asynchronous brake is identical to the effect of the asynchronous motor with the rotating field stationary (F~ = 0), the brake merely consuming much less power than the stationary motor. The eddy current brake is not really a retaining brake since no eddy currents are produced therein when the motor is stationary. However, the eddy current brake is usually sufficient to oppose adequate resistance to any rotation of the motor shaft 2. The main advantage of an eddy current brake is that none of its parts experience mechanical wear. If the driving motor 1 is a synchronous motor, however, the combination with a mechanical brake is preferred to ensure that there is no risk of the rotor turning back slightly at stoppage.

If another advantageous variant, all three phases U~, V~, W~ have, in known manner, a respective control or limiting circuit arrangement $K_u$, $K_v$, $K_w$, 18 for the average value of the phase current to protect the end stages of the three switching amplifiers $\mathbf{17}_u$, $\mathbf{17}_v$, $\mathbf{17}_w$ against overload. This feature compensates for any assymmetries in the impedances of the energizing or exciting windings etc.

Figure 6:
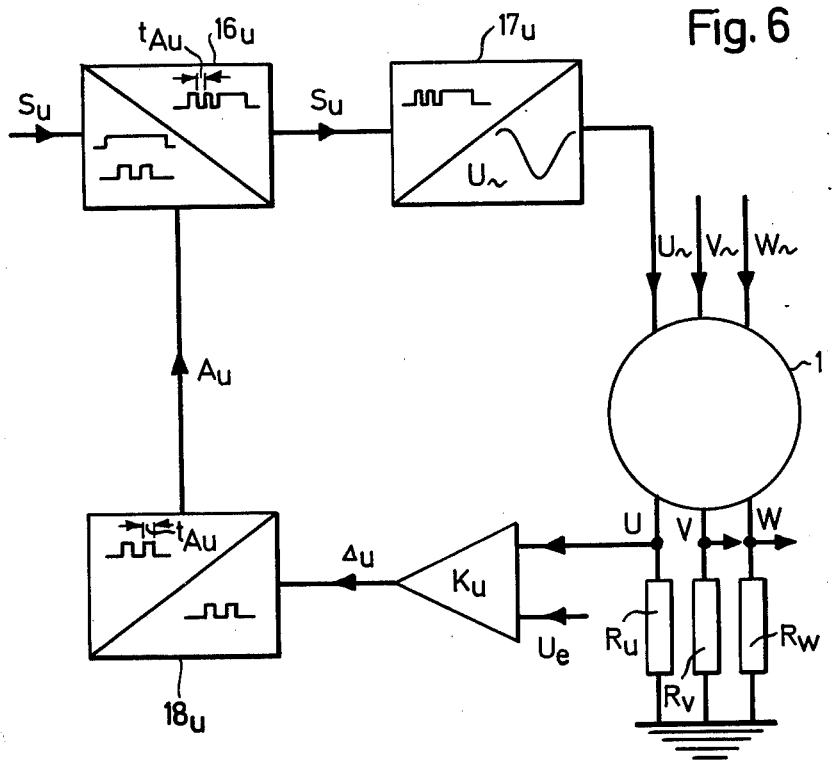
FIG. 6 illustrates a block schematic diagram of the circuitry used to control or limit the current in one phase of the feed current.
Figure 7:
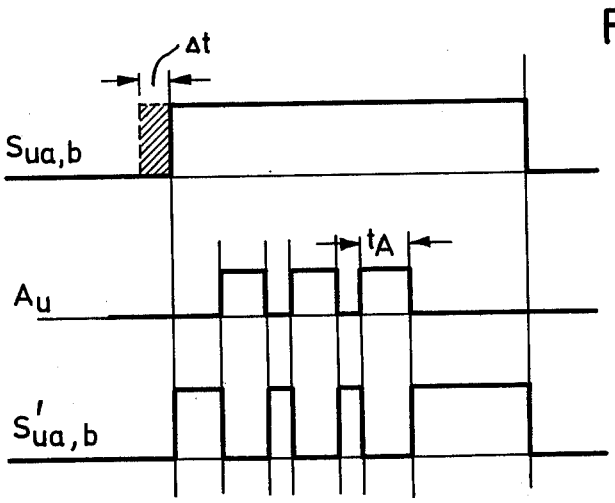
FIG. 7 illustrates a diagram explaining the effect which a circuit of the kind shown in FIG. 6 can provide.

In the limiting circuit, as shown in FIG. 6 for the phase u alone and in FIGS. 1 and 3 for all the phases a resistance $R_u$, $R_v$, $R_w$ is connected to the output of each phase of the exciting winding of the motor 1. Also, a means is provided to tap off from each such resistance, a voltage U, V, W proportional to the phase current U~, V~, W~ to be fed to a comparator $K_u$, $K_v$, $K_w$ and compared with a reference voltage $U_E$, $V_E$, $W_E$. The comparator output $K_u$, $K_v$, $K_w$ is operatively connected, by way of a timing element 18 producing blocking pulses $A_u$, $A_v$, $A_w$ corresponding to the voltage difference $\Delta_u$, $\Delta_v$, $\Delta_w$, to the counting circuit 13 or the particular inverting stage $\mathbf{16}_u$ or $\mathbf{16}_v$ concerned. This causes the rectangular impulses $S_u$, $S_v$, $S_w$ or the control pulses $S_{ua}$, $S_{ub}$ or $S_{va}$, $S_{wa}$ or $S_{wb}$ to be suppressed at each blocking pulse $A_u$, $A_v$, $A_w$ for the duration t of the blocking pulse so that the average duration of the rectangular pulse is reduced. FIG. 7 shows a corresponding pulse diagram for the phase u; $S_{ua,b}$ (see also FIG. 5) indicates the pattern of a still unchanged control pulse at the output of the inverting stage $\mathbf{16}_u$, whether for controlling a positive or a negative current pulse U+ or U− in the push-pull end stage of the switching amplifier $\mathbf{17}_u$, while $A_u$ indicates the pattern of the sequence of blocking pulses produced by the element 18 and $s'_{ua,b}$ indicates the shape of the control pulse reduced by this blockage or inhibition.

The subassembly 19 shown in FIGS. 1 and 3 is a power pack for connection to the local mains supply and serves to produce the d.c. voltages and currents required to operate the various other subassemblies or units. For the sake of clarity in the illustrations, the corresponding supply wiring has been shown only for the switching amplifiers $\mathbf{17}_u$, $\mathbf{17}_v$, $\mathbf{17}_w$ and for the energization of the brake 14; in fact, however, all the appliances and units have to be connected to the power pack 19.

The invention is not limited just to the uses hereinbefore described — i.e., to use as an intermediate store for weft yarn of the kind mentioned. More particularly, intermittent take-up facilities for yarns or strips or the like are known wherein the filamentary substance which is to be stored passes through a stationary guide to be taken up on an intermittently rotating drum or reel or the like, so that the drum is the moving part just referred to, and not the yarn guides, which requires operation through the agency of a drive according to the invention. The invention may also be of use e.g. for all kinds of knitting machine, for machines for producing yarn-reinforced fleeces, for sewing machines or the like.

The direction of rotation of the driving motor is unimportant in the case of the interim weft yarn store chosen as an example, since the weft yarn does not experience additional twisting upon passing through the machine. However, there may well be cases in which the direction of rotation of the take-up devices is important and must be changed in operation. The control and feeding circuit according to the invention can readily be adapted to this circumstance. In order to enable the direction of rotation of the motor 1 to be reversed, and as shown in FIG. 3, a reversing switch 15 is provided to reverse the connections between two of the output terminals $S_v$, $S_w$ of the counting circuit 13 and the corresponding input terminals of the inverting stages $16_v$, $16_w$ so as to change over the two phases v and w. The switch 15 then merely has to change over a low voltage, whereas a heavy reverser would be necessary to change over the corresponding supply wiring of the motor.

The invention thus provides a drive for a yarn feeder or a yarn take-up mechanism which can be operated completely independent from the mains frequency and wherein the speed of the motor can be steplessly adjusted over a wide range. Further, because the drive can be controlled at starting, i.e. being brought to full speed in a continuous manner and without reversing at all at stoppage, loose yarn loops and consequent yarn breakages at the next start are avoided.

What is claimed is:

1. A drive for a yarn feeder for a textile machine comprising a yarn storage device having a storage drum for receiving yarn windings thereon;

a yarn detector for sensing the presence of yarn at a preset point of said drum and for emitting a signal in response thereto, a drive motor for activating said storage device to cause a yarn to wind onto said drum, said motor having a three phase exciting winding therein; and a circuit arrangement for converting a direct current into a variable-frequency three-phase alternating current, said circuit arrangement being connected between said yarn detector and said drive motor for supplying said drive motor with said alternating current in response to the presence of yarn at said preset point of said drum, said circuit arrangement including an integrator responsive to said signal of said yarn detector to produce a trapezoidal control voltage having a value corresponding to a required speed of said motor and having a growth flank and a decay flank determinative of the acceleration time and deceleration of time of said motor;

an oscillator for receiving said control voltage and emitting a control pulse sequence in response thereto, said sequence having a frequency proportional to the value of said control voltage; a digital counting circuit for receiving said control pulse sequence, said circuit having three output terminals corresponding to the three phases of said three-phase alternating current, each said output terminal being adapted to transmit of sequence of identical rectangular pulses with a 120° phase shift from the other of said outputs in consecutive order, each said sequence of rectangular pulses having a frequency of a value proportioned to said control voltage;

three inverter stages, each said stage being connected to a respective terminal of said counting circuit to receive a sequence of rectangular pulses and having two output terminals to emit alternating control pulses in phase opposition to each other in response to said receive rectangular pulses, each said control pulse having a growth flank delayed by a preset time on the decaying flank of an immediately preceding opposed control pulse; and three switching amplifiers, each said amplifier having two input terminals for respectively receiving said control pulses to form a phase current therefrom, a choke for shaping said phase current into a sinusoidal pattern, and an output terminal for emitting said sinusoidal phase current to a respective winding of said drive motor.

2. A drive as set forth in claim 1 wherein said circuit arrangement further comprises a blocking circuit for blocking said circuit arrangement from said exciting current for said motor when said motor is stationary or running at negligible speed.

3. A drive as set forth in claim 1 which further comprises an electromagnetic brake responsive to said yarn detector for braking said motor in response to said signal of said yarn detector.

4. A drive as set forth in claim 3 wherein said brake is a d.c. energized eddy current brake.

5. A drive as set forth in claim 3 wherein said brake is an electromagnetically actuated mechanical brake.

6. A drive as set forth in claim 1 wherein said circuit arrangement further includes a reversing switch connected between two of said output terminals of said counting circuit and a corresponding pair of said inverter stages for switching over said control pulses thereof.

7. A drive as set forth in claim 1 wherein said circuit arrangement further includes a resistance at an output of each phase of said motor winding, means for tapping off a voltage proportional to the phase current at each resistance, a comparator for receiving a reference voltage and a voltage from a respective means for comparison, said comparator having an output connected to one of said counting circuit and a respective inverter stage to emit a blocking pulse corresponding to a difference between said compared voltages to supress the rectangular pulses therein for the duration of said blocking pulse whereby the average duration of a rectangular pulse is reduced.

* * * * *